US010793932B1

(12) United States Patent
Luo et al.

(10) Patent No.: US 10,793,932 B1
(45) Date of Patent: Oct. 6, 2020

(54) METHOD FOR MANUFACTURING LIGHTWEIGHT STEEL PLATE WITH ULTRAHIGH STRENGTH AND HIGH TOUGHNESS

(71) Applicant: University of Science and Technology Beijing, Beijing (CN)

(72) Inventors: Haiwen Luo, Beijing (CN); Guohui Shen, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 0 days.

(21) Appl. No.: 16/830,304

(22) Filed: Mar. 26, 2020

(30) Foreign Application Priority Data

Mar. 28, 2019 (CN) ..... 2019 1 0244716

(51) Int. Cl.

| | |
|---|---|
| ***C21D 9/46*** | (2006.01) |
| ***C22C 38/12*** | (2006.01) |
| ***C22C 38/06*** | (2006.01) |
| ***C22C 38/04*** | (2006.01) |
| ***C22C 38/02*** | (2006.01) |
| ***C21D 6/00*** | (2006.01) |
| ***C22C 38/00*** | (2006.01) |
| ***C21D 8/02*** | (2006.01) |

(52) U.S. Cl.
CPC ..... *C21D 9/46* (2013.01); *C21D 6/005* (2013.01); *C21D 6/008* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01)

(58) Field of Classification Search
None
See application file for complete search history.

(56) References Cited

U.S. PATENT DOCUMENTS

2018/0265942 A1 9/2018 Zhao et al.

FOREIGN PATENT DOCUMENTS

| | | | | |
|---|---|---|---|---|
| CN | 101624681 | B | | 6/2011 |
| CN | 103510017 | A | * | 1/2014 |
| CN | 103510017 | A | | 1/2014 |
| CN | 106119493 | A | * | 11/2016 |
| CN | 106119493 | A | | 11/2016 |
| CN | 106319347 | A | | 1/2017 |
| CN | 104674121 | B | | 3/2017 |
| CN | 105369150 | B | | 3/2017 |
| CN | 107513671 | A | | 12/2017 |

* cited by examiner

*Primary Examiner* — Jenny R Wu
(74) *Attorney, Agent, or Firm* — Bayramoglu Law Offices LLC

(57) ABSTRACT

A method for manufacturing a lightweight steel plate with ultrahigh strength and high toughness includes, in percent by weight: 0.30-0.45 wt % C, 1.0-2.0 wt % Si, 2.0-4.0 wt % Al, 6.0-7.0 wt % Mn, 0.30-0.50 wt % V, 0.02-0.05 wt % Nb, 0.001-0.005 wt % B, N≤0.003 wt %, P≤0.015 wt %, S≤0.005 wt %, Fe, and inevitable impurities.

4 Claims, 4 Drawing Sheets

METHOD FOR MANUFACTURING LIGHTWEIGHT STEEL PLATE WITH ULTRAHIGH STRENGTH AND HIGH TOUGHNESS

CROSS-REFERENCE TO RELATED APPLICATIONS

This application is based on and claims priority to Chinese Patent Application No. 201910244716.9, filed with the National Intellectual Property Administration of P. R. China on Mar. 28, 2019, the entire contents of which are incorporated herein by reference.

TECHNICAL FIELD

The present disclosure relates to the field of metallic materials, more particularly, to a method for manufacturing a lightweight steel plate with ultrahigh strength and high toughness.

BACKGROUND

Ultrahigh-strength and high-toughness steel plates can be applied in transport vehicles, security doors, bank counter protection boards, safety boxes, shields, steel helmets, or the like. The protective performance of the steel plate requires high strength, high toughness, and high hardness, which can enable the steel plate to effectively resist the bullet, thereby preventing the steel plate from being penetrated. The high toughness of the steel plate can maximize the absorption of bullet kinetic energy, thereby preventing steel plates from breaking or cracking.

SUMMARY

Embodiments of the present disclosure provide a method for manufacturing a lightweight steel plate. The method includes: obtaining a molten steel by a converter furnace, an electric furnace or a vacuum induction furnace; obtaining a slab or an ingot based on the molten steel; heating the slab or the ingot to 1050-1200° C. for solution treatment, performing hot rolling on the slab or the ingot to the thickness of 40-80 mm in 3-10 times by a roughing mill, and further hot rolling to the thickness of 4-6 mm in 5-10 times by a finishing mill, and cooling the temperature of the slab or the ingot to an ambient temperature, wherein the thickness reduction for each rolling pass is controlled between 20-40%, and the total thickness reduction in the finishing stage is greater than 90%; and performing tempering process on the hot rolled slab or the ingot, and cooling the temperature of the hot rolled slab or the ingot to the ambient temperature to obtain a steel plate.

It should be understood that the contents described in the summary is neither intended to limit key or important features of the embodiments of the present disclosure, nor to limit the scope of the present disclosure. Other features of the present disclosure will become readily understood from the following description.

DETAILED DESCRIPTION OF THE EMBODIMENTS

Figure 1:
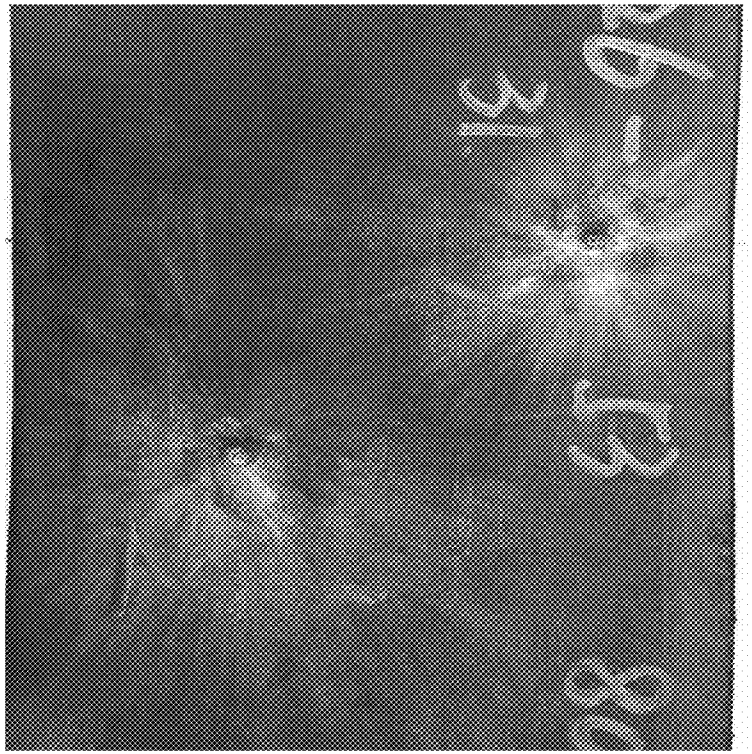
FIG. 1 is a schematic diagram illustrating a front view of two craters on the steel plate after bullet shots according to some embodiments of the present disclosure.

Embodiments of the present disclosure will be described in detail and examples of embodiments are illustrated in the drawings.

The method and device for manufacturing a steel plate, and the steel plate according to embodiments of the present disclosure will be described below with reference to the accompanying drawings.

During over 100 years of development, medium-carbon martensitic and tempered bainitic steels with Cr—Ni—Mo as the main components have become main products. The mixed structure composed of either high-hardness lath martensite or bainite ferrite and carbides can improve the strength and hardness of steel plates, which also have a certain degree of toughness. For example, Chinese Patent Application CN103510017A (Application No. 201210201402.9) discloses an ultrahigh strength, lightweight protective steel plate and the manufacturing method thereof, wherein the steel plate contains 0.25-0.33 wt % C, 0.20-0.40 wt % Si, 1.1-1.50 wt % Mn, and other alloy elements like Cr, Nb, V, Ti, and B. To obtain the tempered martensitic ultrahigh strength steel plate, the manufacturing process includes quenching from the austenitization temperature at 850° C.-900° C., and then tempering at 140-220° C.

Chinese Patent CN104674121B (Application No. 201510104925.5) discloses a high strength protective steel plate with excellent ballistic property and the manufacturing method thereof, wherein the steel contains 0.20-0.28 wt % C, 0.20-0.50 wt % Mn, ≤0.10 wt % Si, and other elements such as Cr, Mo, and Ti. To obtain the tempered martensitic ultrahigh strength steel plate, the manufacturing process includes quenching from the austenitization temperature at 860-900° C., and then tempering at 160-280° C.

Chinese Patent CN105369150B (Application No. 201410426019.2) discloses an ultrahigh strength protective steel plate and the manufacturing method thereof, wherein the steel plate contains 0.50-0.53 wt % C, 1.65-1.85 wt % Si, Mn≤0.20 wt %, and other alloy elements such as Cr, Ni, Mo, and V. To obtain the ultrahigh strength martensitic steel, the manufacturing process includes smelting raw materials in electric arc furnace, refining, casting, electroslag melting, hot rolling, and annealing.

Chinese Patent CN101624681B (Application No. 200910063579.5) reports another ultrahigh strength bainitic protective steel and the manufacturing method thereof, wherein the steel contains 0.70-1.10 wt % C, 1.20-1.80 wt % Si, 1.60-2.20 wt % Mn, 0.05-1.20 wt % Al, and other alloy elements such as Cr, Mo, and Co. To obtain the ultrahigh strength bainitic protective steel, the manufacturing process includes austenitization at 850-1050° C., and then holding for 10-240 h at 200-500° C. in nitrogen atmosphere, followed by cooling to room temperature in furnace; alternatively, holding for 1-4 h at 200-500° C. in nitrogen atmosphere and at 8-12 T in magnetic field, followed by cooling to room temperature in furnace.

However, the steel plates in the related art have the following problems: The steel plate includes a large amount of Cr, Ni and Mo, segregation of alloying elements can easily occur during the solidification of the molten steel, which may deteriorate the performance, and increase the production cost.

The strength of the steel plate is high, and the elongation and toughness of the steel plate is limited, which deteriorate the performance, and increase the production cost.

The carbon content of the steel plate is greater than 0.5%, which can make the steel plate brittle, reduce its plasticity, and have a poor performance in welding.

To achieve lightweight of the steel plate, the strength of the steel plate is improved in order not to reduce the protective performance, which has a high requirement for the steel plate.

It is required to develop a steel plate with high strength and high toughness, cost-effective and lightweight to meet the needs of protection.

Embodiments of the present disclosure provide a method for manufacturing a lightweight steel plate and a lightweight steel plate. The density of the steel plate can be less than 7.4 g/cm3, and after smelting, casting, hot-rolling, and tempering process, the yield strength of the steel plate can be greater than or equal to 1300 MPa, the ultimate tensile strength of the steel plate can be greater than or equal to 2000 MPa, the total elongation of the steel plate can be greater than or equal to 12%, the V-notched impact energy of steel plate at −40° C. can be greater than 45 J, and the steel plate can pass the test of cold bending to 90° angle without cracking. Moreover, the steel plate can defend the perpendicular shot of 7.62 mm steel-core bullet at 820 m/s at the distance of 80 m. The steel plate according to embodiments of the present disclosure has the advantages low-cost, simple and economic alloying compositions and manufacturing processes.

The technical solution of the present disclosure may include the followings. The lightweight steel plate according to embodiments of the present disclosure includes components of, in percent by weight, 0.30-0.45 wt % C, 1.0-2.0 wt % Si, 2.0-4.0 wt % Al, 6.0-7.0 wt % Mn, 0.30-0.50 wt % V, 0.02-0.05 wt % Nb, 0.001-0.005 wt % B, N≤0.003 wt %, P≤0.015 wt %, S≤0.005 wt %, and the balance is Fe and inevitable impurities.

The lightweight steel plate further includes one or more elements: 0.5-2.0 wt % Cr, 0.5-3.0 wt % Ni, 0.1-1.0 wt % Mo, 0.1-1.0 wt % Co, 0.1-1.0 wt % Cu, 0.1-0.5 wt % Ti, 0.002-0.005 wt % RE, and 0.005-0.03 wt % Ca.

The lightweight steel plate with ultrahigh strength and high toughness has a thickness of 4-6 mm.

The method for manufacturing a lightweight steel plate with ultrahigh strength and high toughness may include the following acts.

The chemical components are proportionally mixed, the molten steel is smelted according to the chemical compositions, and then refined through a converter furnace, an electric furnace or a vacuum induction furnace. The molten steel is casted into a slab, and molded into an ingot. The slab or the ingot are heated at 1050-1200° C. for solution treatment, hot rolling is performed on the slab or the ingot in 3-10 times by a roughing mill to cause a thickness of the slab or the ingot to 40-80 mm, and then hot rolling is performed on the slab or the ingot in 5-10 times by a finishing mill to cause the thickness of the slab or the ingot to 4-6 mm with the finish rolling temperature at 800-900° C., and the slab or the ingot is cooled to an ambient temperature. The rolling reduction of each hot rolling is controlled between 20-40%, and a total thickness reduction rate in a finishing stage is greater than 90%. The hot rolled steel plate is tempered at 150-300° C. for 1-2 hours, and is cooled to the ambient temperature, the obtained lightweight steel plate has the following properties: density <7.4 g/cm3, hardness: 560-705 HBW, yield strength≥1300 MPa, ultimate tensile strength≥2000 MPa, total elongation≥12%, the V-notched impact energy at −40° C.>45 J. Moreover, the steel plate can pass the test of cold bending to 90° angle without cracking, and succeed in defending the perpendicular shot of 53-type 7.62 mm steel-core bullet.

Figure 2:
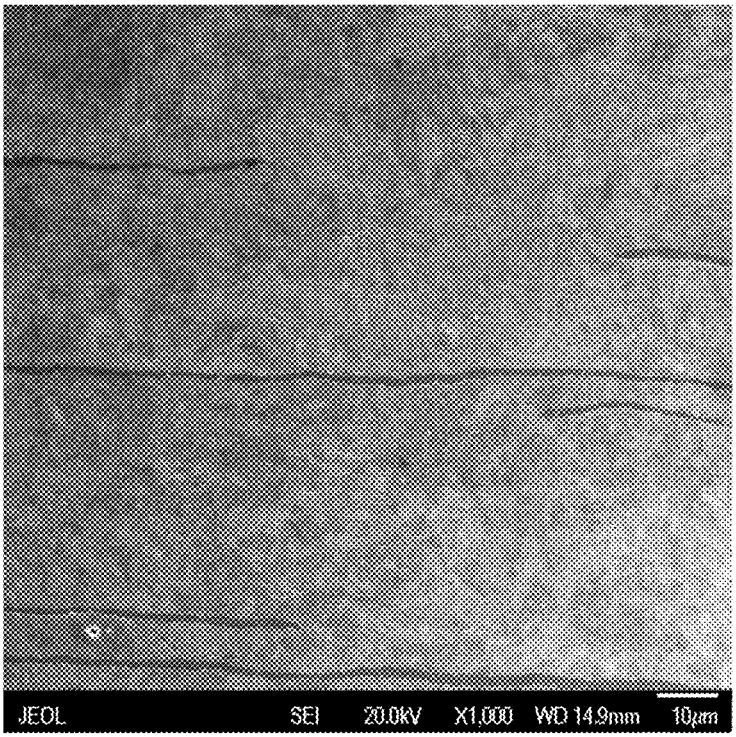
FIG. 2 is a schematic diagram illustrating a SEM image of a steel plate after tempering at 200° C. for 1 hour according to some embodiments of the present disclosure.
Figure 3:
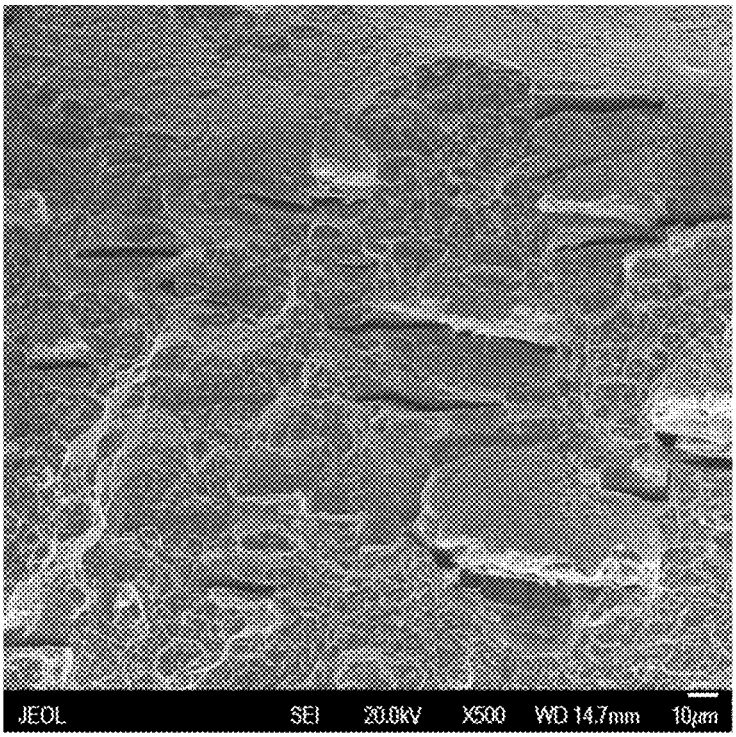
FIG. 3 is a schematic diagram illustrating a SEM image of a V-notched impact fracture at −40° C. of a steel plate after tempering at 200° C. for 1 hour according to some embodiments of the present disclosure.
Figure 4:
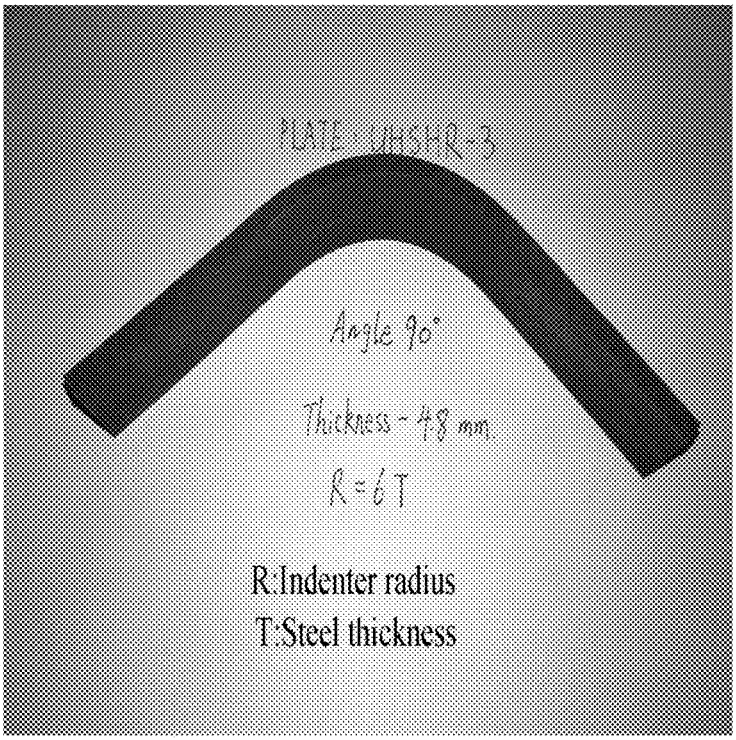
FIG. 4 is a schematic diagram illustrating a photograph of cold bending test to 90° angle of a steel plate after tempering at 200° C. for 1 hour according to some embodiments of the present disclosure.

The microstructures of the lightweight steel plate with ultrahigh strength and high toughness according to embodiments of the present disclosure includes martensite as the matrix, a certain fraction of elongated δ ferrite, and retained austenite. Fine precipitates are distributed in δ-ferrite and at grain boundaries, which improves the yield strength of the steel plate. When subjected to external force, the soft δ-ferrite and the retained austenite may undergo plastic deformation, absorb and consume energy to delay or change the propagating path of crack, which can improve the toughness. Moreover, as the external force increases, the plasticity effect induced by austenite transformation (TRIP effect) can further enhance the tensile strength and plasticity. FIG. 1 is a schematic diagram illustrating a front view of two craters on the steel plate after bullet shots according to some embodiments of the present disclosure. FIG. 2 is a schematic diagram illustrating a SEM image of a steel plate after tempering at 200° C. for 1 hour according to some embodiments of the present disclosure. FIG. 3 is a schematic diagram illustrating a SEM image of a V-notched impact fracture at −40° C. of a steel plate after tempering at 200° C. for 1 hour according to some embodiments of the present disclosure. FIG. 4 is a schematic diagram illustrating a photograph of cold bending test to 90° angle of a steel plate after tempering at 200° C. for 1 hour according to some embodiments of the present disclosure.

The lightweight steel plate according to embodiments of the present disclosure does not include precious elements such as Cr, Ni, Mo and Co, and only includes general elements such as C, Mn, Si and Al, and microalloying elements such as V, Nb and B, which improves the hardenability of the steel via the alloying of precious elements, and a high content of element Mn can improve the hardenability of the lightweight steel plate. Moreover, the segregation of element Mn can enhance mechanical stability and fraction of retained austenite, and the increase of strength is attributed to multiple mechanisms including TRIP effect, grain refinement and precipitation strengthening. In the present disclosure, the density of the steel plate is reduced by the addition of a preset amount of lightweight elements such as Si and Al. The density of the ultrahigh strength and high toughness steel plate can be reduced to less than 7.4 g/cm3, such that the maneuverability of vehicles can be enhanced without reducing the protective ability of the steel plate.

In the related art, the method for manufacturing the steel plate is complicated, involving smelting, refining, continuous casting, hot rolling, re-austenitization, tempering or using external magnetic field, which are time and energy consuming. In the present disclosure, the hot rolled steel plate is subjected to a low-temperature tempering treatment, which is rather simple process to save time and energy while maintain the good performance.

In some embodiments, the method for manufacturing a lightweight steel plate with ultrahigh strength and high toughness is provided, the steel plate includes following elements, in percent by weight: 0.30-0.45 wt % C, 1.0-2.0 wt % Si, 2.0-4.0 wt % Al, 6.0-7.0 wt % Mn, 0.30-0.50 wt % V, 0.02-0.05 wt % Nb, 0.001-0.005 wt % B, ≤0.003 wt % N, ≤0.015 wt % P, ≤0.005 wt % S, Fe, and inevitable impurities. The weight percentage content of C in the molten steel is 0.30-0.45 wt %, the weight percentage content of Si in the molten steel is 1.0-2.0 wt %, the weight percentage content of Al in the molten steel is 2.0-4.0 wt %, the weight percentage content of Mn in the molten steel is 6.0-7.0 wt %, the weight percentage content of V in the molten steel is 0.30-0.50 wt %, the weight percentage content of Nb in the molten steel is 0.02-0.05 wt %, the weight percentage content of B in the molten steel is 0.001-0.005 wt %, the weight percentage content of N in the molten steel is less than or equal to 0.003 wt %, the weight percentage content of P in the molten steel is less than and equal to 0.015 wt %, and the weight percentage content of S in the molten steel is less than and equal to 0.005 wt %.

Figure 5:
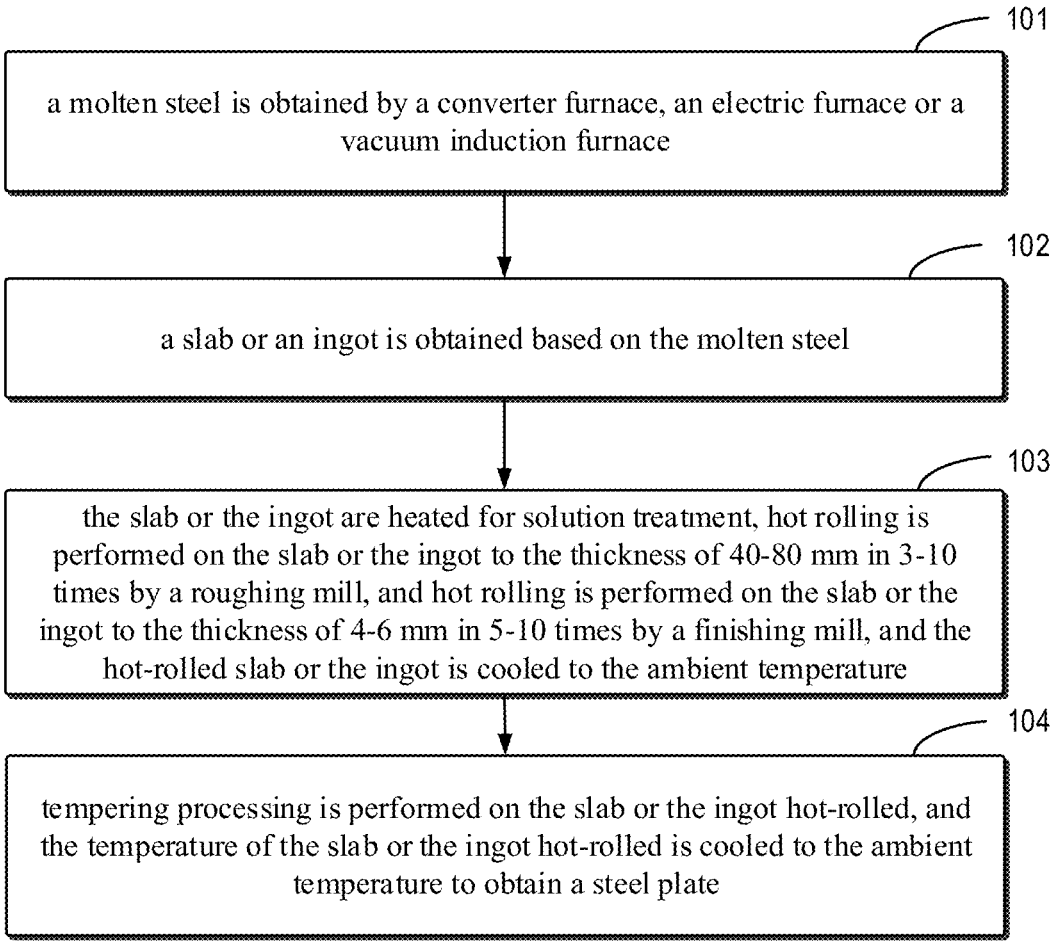
FIG. 5 is a flowchart of a method for manufacturing a lightweight steel plate with ultrahigh strength and high toughness.

FIG. 5 is a flowchart of a method for manufacturing a lightweight steel plate with ultrahigh strength and high toughness, as shown in FIG. 5, the method for manufacturing the lightweight steel plate with ultrahigh strength and high toughness may include the following acts.

At block 101, a molten steel is obtained by a converter furnace, an electric furnace or a vacuum induction furnace.

In some embodiments, the molten steel includes, in percent by weight: 0.30-0.45 wt % C, 1.0-2.0 wt % Si, 2.0-4.0 wt % Al, 6.0-7.0 wt % Mn, 0.30-0.50 wt % V, 0.02-0.05 wt % Nb, 0.001-0.005 wt % B, ≤0.003 wt % N, ≤0.015 wt % P, ≤0.005 wt % S, Fe, and inevitable impurities.

At block 102, a slab or an ingot is obtained based on the molten steel.

At block 103, the slab or the ingot are heated for solution treatment, hot rolling is performed on the slab or the ingot to the thickness of 40-80 mm in 3-10 times by a roughing mill, and hot rolling is performed on the slab or the ingot to the thickness of 4-6 mm in 5-10 times by a finishing mill, and the hot rolled slab or the ingot is cooled to the ambient temperature.

In some embodiments, the slab or the ingot is heated at 1050-1200° C. for solution treatment. The thickness reduction for each hot rolling pass is controlled between 20-40%, and the total thickness reduction in the finishing stage is greater than 90%.

At block 104, tempering process is performed on the hot rolled slab or the ingot, and the temperature of the hot rolled slab or the ingot is cooled to the ambient temperature to obtain a steel plate.

The elements described above are obtained and proportionally mixed to obtain the molten steel, the molten steel is smelted and refined through a converter furnace, an electric furnace or a vacuum induction furnace to obtain the slab with 50 mm thickness.

The slab is heated at 1150° C. for 2 hours, and hot rolled to the thickness of 5 mm in 8-9 times with the temperature of 1100° C. to 800° C., and then the slab is cooled to the ambient temperature.

The hot rolled steel plate is subjected to tempering at 150-300° C. for 1-2 hours, and then cooled to the ambient temperature. After cooling, the steel plate specimen with the length of 400 mm is cut for ballistic test, a steel plate specimen with the length of 200 mm is conducted for 90° angle cold bending test, and another steel plate specimen with the gauge length of 25 mm is processed for tensile test.

Embodiments of the present disclosure further provide a method for manufacturing a lightweight steel plate with ultrahigh strength and high toughness according to some other embodiments of the present disclosure, the steel plate comprises 0.41 wt % C, 1.67 wt % Si, 3.53 wt % Al, 6.89 wt % Mn, 0.45 wt % V, 0.044 wt % Nb, 0.0035 wt % B, N≤0.003 wt %, S≤0.005 wt %, P≤0.015 wt %, and with the balance being Fe and inevitable impurities.

The method may include the following acts. The elements described above are obtained and proportionally mixed to obtain the molten steel, the molten steel is smelted and refined through a converter furnace, an electric furnace or a vacuum induction furnace to obtain the slab with 70 mm thickness. The slab is heated at 1200° C. for 2 hours, and hot rolled to the thickness of 4.5 mm in 7-8 times with the temperature of 1150° C. to 850° C., and then the slab is cooled to the ambient temperature.

The hot rolled steel plate is subjected to tempering at 150-300° C. for 1-2 hours, and then cooled to the ambient temperature. After cooling, the steel plate specimen with the length of 400 mm is cut for ballistic test, the steel plate specimen with the length of 200 mm is conducted for 90° angle cold bending test, and another steel plate specimen with the gauge length of 25 mm is processed for tensile test.

TABLE 1

Comparison of Mechanical Properties between Embodiments and Comparative Examples

| Number | Thickness/ mm | Tempering Process/° C. | Hardness/ HBW | YS/MPa | UTS/MPa | TE/% | Impact energy at -40° C./J, |
|---|---|---|---|---|---|---|---|
| Sample 1 in embodiment 1 | 4.77 | 150° C., 1 h | 595-785 | 1300 | 2120 | 11.78 | 49 |
| Sample 2 in embodiment 1 | 4.84 | 200° C., 1 h | 560-739 | 1305 | 2055 | 12.65 | 56 |
| Sample 3 in embodiment 1 | 4.83 | 300° C., 1 h | 580-790 | 1370 | 1800 | 16.85 | 60 |
| Sample 1 in embodiment 2 | 4.52 | 150° C., 2 h | 610-785 | 1305 | 2120 | 12.73 | 52 |
| Sample 2 in embodiment 2 | 4.82 | 350° C., 1 h | 560-688 | 1390 | 1795 | 14.20 | 62 |
| SSAB sample 1 | 4-30 | <170° C. | 420-480 | 1100 | 1550 | 10 | 45 |
| SSAB sample 2 | 3-80 | <190° C. | 480-540 | 1250 | 1750 | 8 | 32 |
| SSAB sample 3 | 3-15 | Quenched | 540-600 | 1550 | 1850 | 7 | 16 |
| SSAB sample 4 | 4-7.9 | Quenched | 615-705 | — | — | — | — |

As can be seen from Table 1, the lightweight steel plate with ultrahigh strength and high toughness according to embodiments of the present disclosure has higher hardness, ultimate tensile strength, and high total elongation, and has great anti-ballistic performance. Furthermore, the lightweight steel plate has a low density, and is simple to manufacture, which can be widely used in civil protection fields such as armored cash transport cars, prisoner transport vehicles, VIP transport vehicles, security doors, bank counter protection boards, safes, shields, steel helmets, and the like.

What is claimed is:

1. A method for manufacturing a steel plate, comprising the following steps:

(1) smelting: obtaining a molten steel by a converter furnace, an electric furnace or a vacuum induction furnace, wherein the molten steel comprises, in percent by weight: 0.30-0.45 wt % C, 1.0-2.0 wt % Si, 2.0-4.0 wt % Al, 6.0-7.0 wt % Mn, 0.30-0.50 wt % V, 0.02-0.05 wt % Nb, 0.001-0.005 wt % B, ≤0.003 wt % N, ≤0.015 wt % P, ≤0.005 wt % S, Fe, and inevitable impurities;

(2) casting: obtaining a slab by continuous casting based on the molten steel obtained in step (1), or obtaining an ingot by mold casting based on the molten steel obtained in step (1);

(3) hot rolling: heating the slab or the ingot at 1050-1200° C., performing the hot rolling on the slab or the ingot to a thickness of 40-80 mm in 3-10 times by a roughing mill, and further performing the hot rolling on the slab or the ingot at 1050-1200° C. to a thickness of 4-6 mm in 5-10 times by a finishing mill to obtain a hot rolled slab or a hot rolled ingot, and cooling a temperature of the hot rolled slab or the hot rolled ingot to room temperature, wherein a thickness reduction for each hot rolling pass is controlled between 20-40%, and a total thickness reduction in a finishing stage is greater than 90%; and (4) tempering: performing a tempering process on the hot rolled slab or the hot rolled ingot, and cooling the temperature of the hot rolled slab or the hot rolled ingot to room temperature to obtain the steel plate, wherein a density of the steel plate is less than 7.4 g/cm$^3$, a yield strength of the steel plate after heat treatment is greater than or equal to 1300 MPa, a tensile strength of the steel plate is greater than or equal to 2000 MPa, an elongation of the steel plate is greater than or equal to 12%, an impact energy of the steel plate at −40° C. is greater than 45 J, the steel plate can pass a test of cold bending to 90° angle without cracking and succeed in defending a shot of 53-type 7.62 mm steel-core bullet.

2. The method of claim 1, wherein in step (3), a finish rolling temperature of the hot rolling is controlled to 800-900° C.

3. The method of claim 1, wherein in step (4), a temperature of the tempering process is controlled to 150-300° C., and a duration of the tempering process is 1-2 hours.

4. A steel plate prepared by the method of claim 1, wherein the slab or the ingot obtained in step (2) is further added with one or more selected from the group consisting of 0.5-2.0 wt % Cr, 0.5-3.0 wt % Ni, 0.1-1.0 wt % Mo, 0.1-1.0 wt % Co, 0.1-1.0 wt % Cu, 0.1-0.5 wt % Ti, 0.002-0.005 wt % Re, and 0.005-0.03 wt % Ca to improve performance of the steel plate.

* * * * *